United States Patent [19]

Henne

[11] 3,953,149

[45] Apr. 27, 1976

[54] ENGINE COOLING FAN

[75] Inventor: John G. Henne, Saginaw, Mich.

[73] Assignee: General Motors Corporation, Detroit, Mich.

[22] Filed: June 17, 1974

[21] Appl. No.: 479,805

[52] U.S. Cl. ..... 416/136; 416/140; 416/208; 416/241 A; 416/43

[51] Int. Cl.[2] ..... F04D 29/36

[58] Field of Search ..... 416/131, 135, 139, 136, 416/140, 138, 241 A, 230, 205, 207, 208, 43, 44

[56] References Cited

UNITED STATES PATENTS

| | | | |
|---|---|---|---|
| 2,047,776 | 7/1936 | Hafner | 416/135 |
| 2,146,367 | 2/1939 | Berliner | 416/136 |
| 2,844,207 | 7/1958 | Curley | 416/207 |
| 3,204,702 | 9/1965 | Brown | 416/140 X |
| 3,220,484 | 11/1965 | Elmer | 416/136 X |
| 3,260,312 | 7/1966 | Elmer | 416/241 A X |
| 3,388,749 | 6/1968 | Woods et al. | 416/241 A X |

FOREIGN PATENTS OR APPLICATIONS

| | | | |
|---|---|---|---|
| 385,074 | 2/1933 | United Kingdom | 416/136 |
| 865,102 | 5/1941 | France | 416/136 |
| 1,334,843 | 7/1963 | France | 416/136 |
| 1,370,754 | 7/1964 | France | 416/136 |
| 1,503,480 | 7/1970 | Germany | 416/241 |
| 57,405 | 5/1946 | Netherlands | 416/136 |
| 675,377 | 5/1939 | Germany | 416/44 |

*Primary Examiner*—Everette A. Powell, Jr.
*Attorney, Agent, or Firm*—John P. Moran

[57] ABSTRACT

An automotive engine cooling fan assembly including asymmetrical plastic fan blades and a torsion bar interconnecting each blade to the hub of the assembly, the asymmetrical blades responding to both aerodynamic and centrifugal forces to reduce the pitch thereof at high fan speeds, the entire fan blade subassembly being rotated as a result of the twisting of the torsion bar.

2 Claims, 6 Drawing Figures

ENGINE COOLING FAN

This invention relates generally to automotive engine cooling fan assemblies and, more particularly, to variable-pitch plastic bladed fan assemblies.

Heretofore automotive engine cooling fan assemblies, which have operated independently of viscous fluid clutches, have included various techniques for varying their blade-pitch in response to speed changes. Such techniques have included utilizing mechanically pivotable blades; flexible blades with their inherent blade stresses; and symmetrical blades in conjunction with double-looped torsion springs, such as the arrangement covered by Elmer U.S. Pat. Nos. 3,217,808 and 3,220,484. However, such arrangements are not entirely suitable for engine cooling fan assemblies having light-weight fan blades, such as plastic or aluminum, for which the centrifugal depitching forces are relatively small. Hence, it is advantageous to provide an automotive engine cooling fan assembly wherein aerodynamic depitching forces are employed to supplement any centrifugal depitching forces, the aerodynamic forces providing a significant percentage of the total depitching forces at fan speeds where a reduction of the effective blade pitch is desirable.

Accordingly, an object of the invention is to provide an improved automotive engine cooling plastic-bladed fan assembly, wherein the pitch of the blades thereof is automatically varied as a result of both aerodynamic and centrifugal forces, for better cooling and noise abatement characteristics.

Another object of the invention is to provide an improved engine cooling fan assembly having plastic asymmetrical blades, each of which is connected by a suitable torsion bar to the hub of the fan assembly, with such blades responding to both centrifugal and aerodynamic forces to effectively vary the pitch in response to changes in fan speed.

A further object of the invention is to provide an engine cooling fan assembly including a hub, a plurality of plastic asymmetrical blades, a torsion bar having square ends for driving connection between the hub and the blades, fastening means for retaining the blades radially on the hub, and cooperative stop means formed on each blade and on the hub for establishing the proper torsion-bias on each blade, while permitting each blade to effectively depitch in response to increasing fan speed.

Still another object of the invention is to provide an aerodynamic force-responsive variable-pitch engine cooling fan assembly, wherein the hub associated therewith is a single member in one embodiment, and a two-piece split-type member in a second embodiment.

These and other objects and advantages of the invention will be apparent when reference is made to the following description and accompanying drawings, wherein.

Figure 1:
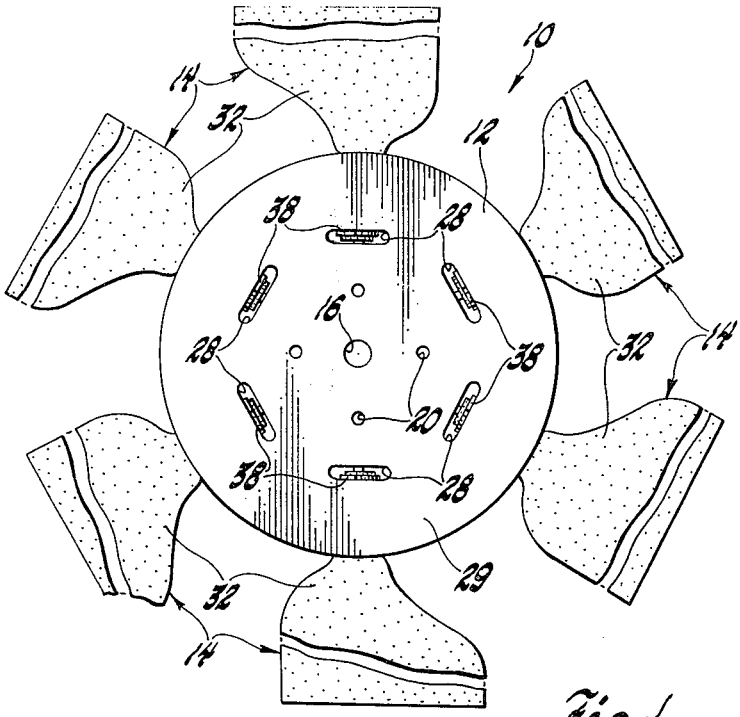
FIG. 1 is a fragmentary front view of an automotive engine cooling fan assembly embodying the invention.
Figure 2:
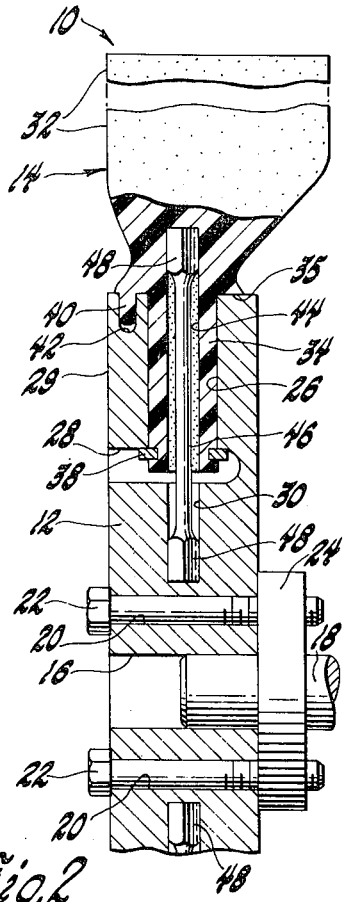
FIG. 2 is an enlarged fragmentary cross-sectional view of a portion of the FIG. 1 structure.

Referring now to the drawings in greater detail, FIG. 1 illustrates a fan assembly 10 including a hub 12 and a plurality of fan blade subassemblies 14 operatively connected thereto. As shown in FIG. 2, the hub 12 includes a central opening 16 suitable for mounting on a drive shaft 18, such as a water pump shaft. A plurality of openings 20 are formed through the hub 12, around the central opening 16, suitable for insertion therethrough of bolts 22 which threadedly secure the hub 12 to a flange 24 formed on the drive shaft 18.

A plurality of radially extending circular openings 26 are formed to a predetermined depth in the outer peripheral edge of the hub 12. Tangential slots 28 are formed in the front face 29 of the hub 12 so as to laterally intersect the bottom or innermost ends of the respective circular openings 26. A square or oval or other suitable drive-configuration shaped opening 30 is formed in the hub 12, radially inwardly of each tangential slot 28, and axially aligned with the respective circular openings 26.

Figure 3:
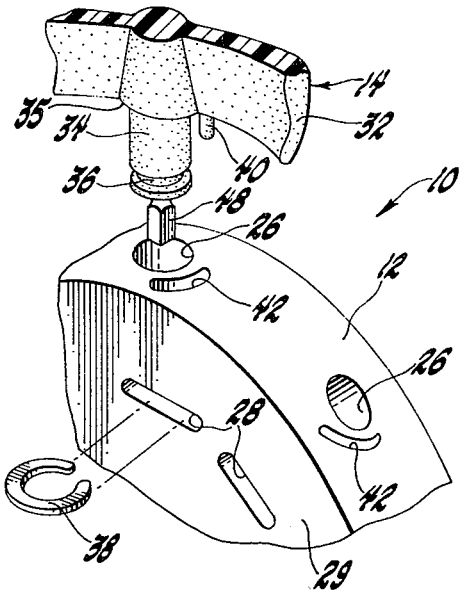
FIG. 3 is a fragmentary perspective view of a portion of the FIG. 1 structure.

As may be noted in FIGS. 2 and 3, each fan blade subassembly 14 includes an asymmetrical blade 32 formed of a suitable plastic material, each blade 32 having a round stem 34 formed on and extending from the inner mounting surface 35 (FIG. 2) thereof for insertion in each respective circular opening 26 in the hub 12. An annular groove 36 is formed around each stem 34 adjacent the free end thereof for the mounting thereon of a C-shaped retainer or snap-ring 38 (FIG. 3), the latter being inserted through the respective tangential slots 28 to thereby retain a blade subassembly 14 in place on the hub 12. A finger-like projection or stop-pin 40 is formed on the inner mounting surface 35 of each blade 32, extending therefrom parallel to the axis of the stem 34, for insertion in an arcuate slot 42 formed to a predetermined length and depth in the outer periphery of the hub 12 adjacent each circular opening 26.

A square or oval or other suitable drive-configuration shaped opening 44 (FIG. 2) is formed to a predetermined depth along the axis of each stem 34 so as to conform to, and to be axially aligned with, each respective opening 30 formed in the hub 12. A torsion bar 46, having a square or spade-like configuration 48 formed on each end thereof, suitable for mounting in the respective cooperatively shaped openings 44 and 30 of each blade subassembly 14 and in the hub 12 during the assembly process, at which time a predetermined maximum pitch position of each blade 32 is selected with respect to the plane of the hub 12, and maintained by virtue of each stop-pin 40 being torsionally biased against an end of the respective arcuate slot 42.

OPERATION

In operation, the cooling fan assembly 10 rotates in a clockwise direction, as viewed from the front thereof in FIG. 1. As such, the blade area of each asymmetrical blade 32 in front of the pivot axis thereof is minimal, while the blade area in the rear of the pivot axis thereof is maximal. At low rotational fan speeds, each blade 32 is maintained in the maximum pitch position (FIG. 4) by virtue of the predetermined torsional twist of the torsion bar 46, urging the stop-pin 40 against the left end (FIG. 3) of the arcuate slot 42, as indicated above.

As fan speed is increased, aerodynamic and centrifugal forces on the blades 32 create a progressively increasing counterclockwise torque (FIG. 4) on the blades 32 about the pivot axis thereof along the respective centers of the stems 34. Such counterclockwise movement of the blades 32 progressively winds up the respective torsion bars 46, retained at their outer ends in the axially aligned drive-configuration openings 30 and 44 formed respectively in the hub 12 and the rotatable stems 34. This causes each blade 32 to feather-out, thereby progressively decreasing the pitch of each fan blade 32 toward the minimum pitch position illustrated in the dash-lines of FIG. 4, while winding up the respective torsion bars 46. The minimum pitch position is established when each stop-pin 40 contacts the other or right-hand end (FIG. 3) of each respective arcuate slot 42.

Figure 4:
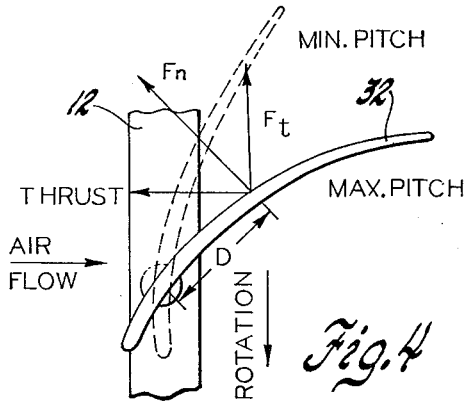
FIG. 4 is a schematic illustration of operational characteristics of the invention.

As graphically illustrated in FIG. 4, the aerodynamic moment is equal to $DF_n$, where "D" is the distance from the pivot axis to the center of aerodynamic pressure, and $F_n$ is the normal or resultant force of the axial thrust force and the tangential force $F_t$ resulting from work done in moving air. Such resultant aerodynamic force $F_n$ is a substantial component of the total aerodynamic and centrifugal depitching moments which would act on each fan blade 32 made of plastic, for example.

It should be apparent that maximum and minimum pitch positions for the blades 32 may be selectively controlled by the predetermined preload, length, thickness and spring rate of the torsion bars 46; the location of the stop-pins 40 on the respective blades 32; and the length of the arcuate slots 42, providing a means for matching the cooling and noise-abatement characteristics of the fan 10 with substantially any engine cooling application requirements.

FIG. 5 EMBODIMENT

Figure 5:
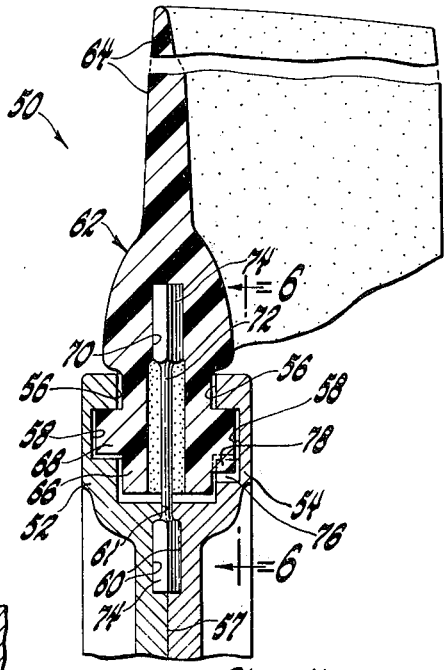
FIG. 5 is an enlarged fragmentary view of an alternate embodiment of the invention.

Referring now to the FIG. 5 embodiment, the fan assembly 50 illustrated therein includes a split-hub arrangement, including mating hub-halves 52 and 54. Each of the hub-halves 52 and 54 has a semicylindrical opening 56 formed in the outer peripheral edge and along the mating face 57 thereof. A semi-cylindrical groove 58 is formed at an intermediate longitudinal location along each semicylindrical opening 56. Each hub-half 52 and 54 has a V-shaped pocket 60 formed in the mating face 57 thereof, radially inwardly of the inner end of the semicylindrical opening 56. A semicylindrical opening 61 is also formed in the face 57 so as to interconnect the V-shaped pocket 60 and the semicylindrical opening 56.

Each fan blade subassembly 62 includes an asymmetrical blade 64 formed of suitable plastic material and having a round stem 66 formed thereon. A collar or flange 68 is formed around each stem 66 at an intermediate longitudinal location therealong. A square-shaped opening 70 is formed along the axis of each stem 66. A torsion bar 72, having squared ends 74, has one end 74 thereof mounted in the square-shaped opening 70 of the fan blade subassembly 62, the other end thereof mounted in the oppositely disposed mating V-shaped pockets 60 of the hub-halves 52 and 54, the mating semicylindrical openings 61 providing access therebetween.

Figure 6:
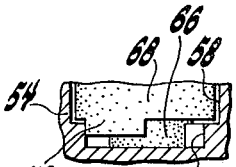
FIG. 6 is a fragmentary cross-sectional view taken along the plane of line 6—6 of FIG. 5, and looking in the direction of the arrows.

Referring now to FIG. 6, it may be noted that an arcuate slot 76 is formed in the hub-half 54 adjacent the semi-cylindrical groove 58, and that an arcuate projection 78, shorter in length than the arcuate slot 76, is formed on the collar 68, extending into the arcuate slot 76. The projection 78 and the slot 76 perform the same function as the stop-pin 40 and arcuate slot 42 of the FIGS. 1–3 embodiment.

Once assembled as shown in FIG. 5, i.e., with the stem 66 of each fan blade subassembly 62 mounted in the mating semi-cylindrical openings 56, and the collars or flanges 68 mounted in the semicylindrical arcuate grooves 58, the cooling fan assembly 50 operates substantially identically to the operation of the cooling fan assembly 10 discussed above.

It should be apparent that the invention provides an improved variable-pitch plastic-bladed fan assembly, wherein asymmetrical plastic blades are connected via a torsion bar to either a single or split-type fan hub, each with means formed thereon for providing maximum and minimum limits for rotation of the blades, with the depitching forces consisting of aerodynamic and centrifugal forces.

While but two embodiments of the invention have been shown and described, other modifications thereof are possible.

I claim:

1. An automotive engine cooling fan assembly comprising a split-type hub having mating halves, a plurality of radially extending semicylindrical openings formed to a predetermined depth in the outer peripheral edge of each of said hub-halves adjacent the mating face thereof, a plurality of fan blade subassemblies, each including an asymmetrical fan blade having a round stem formed thereon and mounted in said oppositely disposed semicylindrical openings, radially aligned drive-configuration shaped openings formed along the axis of said round stems and in said mating faces of said hub-halves radially inwardly of said semicylindrical openings, a torsion bar having drive-configuration shaped ends mounted in said respective radially aligned drive-configuration shaped openings, an arcuate slot formed in each of said hub-halves at an intermediate longitudinal location along each of said semicylindrical openings, collar means formed on each of said stems and positioned in said respective adjacent slots to retain said stems in said semicylindrical openings, and cooperating projecting and additional arcuate slot means formed on each of said fan blades and one of said hub-halves for establishing maximum and minimum pitch positions by limiting the rotation of said blades about the axis of each of said stems under the action of aerodynamic forces on said asymmetrical fan blades at predetermined high fan speeds against the force of said torsion bar.

2. An automotive engine cooling fan assembly comprising a split-type hub having mating halves, a plurality of radially extending semicylindrical openings formed to a predetermined depth in the outer peripheral edge of each of said hub-halves adjacent the mating face thereof, a plurality of fan blade subassemblies, each including an asymmetrical fan blade having a round stem formed thereon and mounted in oppositely disposed semicylindrical openings, a square-shaped opening formed along the axis of each of said round stems, a V-shaped pocket formed in said mating face of each of said hub-halves radially inwardly of said semicylindrical openings, a torsion bar having squared ends mounted at one end thereof in each of said square-shaped openings and at the other end thereof in each square-shaped opening formed by adjacent mating V-shaped pockets, a semicylindrical groove formed at an intermediate longitudinal location along each of said semicylindrical openings, a collar formed on each of said stems and positioned in each semicylindrical opening formed by adjacent mating semicylindrical grooves for retaining said stems in said semicylindrical openings, an arcuate slot formed in one of said hub-halves adjacent said semicylindrical opening formed therein, an arcuate-shaped projection formed on said collar and having a length shorter than the length of said arcuate slot for insertion in said arcuate slot initially torsionally biased against one end thereof by said torsion bar for limiting the rotation of said blades about the axis of each of said stems under the action of aerodynamic forces on said asymmetrical fan blades at predetermined high fan speeds against the force of said torsion bar.

* * * * *